United States Patent [19]

Crook, Jr.

[11] Patent Number: 4,493,135

[45] Date of Patent: Jan. 15, 1985

[54] FITTING FOR CONNECTION WITH WEB-TYPE STRAPPING

[75] Inventor: Edward J. Crook, Jr., Tulsa, Okla.

[73] Assignee: The Crosby Group, Inc., Tulsa, Okla.

[21] Appl. No.: 479,755

[22] Filed: Mar. 28, 1983

[51] Int. Cl.[3] ..... A44B 11/00

[52] U.S. Cl. ..... 24/197; 24/68 E; 24/193; 24/196; 24/200

[58] Field of Search ..... 24/197, 196, 193, 200, 24/68 F, 68 E, 265 R, 265 CD, 265 AL, 265 B; 294/74

[56] References Cited

U.S. PATENT DOCUMENTS

| | | | |
|---|---|---|---|
| 2,710,999 | 6/1955 | Davis | 24/197 |
| 2,754,560 | 7/1956 | Warner et al. | 24/196 |
| 2,936,500 | 5/1960 | Elsner | 24/196 |
| 3,060,537 | 10/1962 | Hatfield | 24/197 |
| 3,231,953 | 2/1966 | McHenry | 24/197 |
| 3,274,656 | 9/1966 | Hamann | 24/196 |
| 3,344,486 | 10/1967 | Eveland | 24/196 |
| 4,395,796 | 8/1983 | Akaura et al. | 24/265 CD |

FOREIGN PATENT DOCUMENTS

| | | | |
|---|---|---|---|
| 40670 | 12/1973 | Australia | 24/196 |
| 215429 | 9/1967 | Sweden | 24/193 |
| 878051 | 9/1961 | United Kingdom | 24/68 E |

*Primary Examiner*—Victor N. Sakran

*Attorney, Agent, or Firm*—Head, Johnson & Stevenson

[57] ABSTRACT

A fitting for flexible fabric type web slings.

5 Claims, 7 Drawing Figures

FITTING FOR CONNECTION WITH WEB-TYPE STRAPPING

BACKGROUND OF THE INVENTION

The field of this invention is in fittings for connection with flexible fabric type web slings used in lifting or strapping articles. Such slings are typically found as a continuous fixed-length member with sewn eyes at each end or attached to metal fittings at each end by turning back a free end of the webbing material and sewing it and the working end together. Sewing of typical webbing materials, such as nylon, detracts from the true strength of the material. Thus it is customary in design work, to reduce the strength of the webbing by a factor of 20 percent for the adverse effect of needle damage during sewing. In addition, when a continuous or sewn sling becomes worn beyond use, the user has no alternative but to discard the sling. In those instances where a sling is in combination with metal fittings a worn sling is taken from service and returned to a manufacturer who can remove the fittings and fabricate a new sling using the removed fittings, involving time and cost. As stated, a sewn type of web sling is made to a pre-determined length and not adjustable to varying geometrical shapes and sizes of loads.

Typical of the prior art to which this invention is an improvement is found in U.S. Pat. No. 4,365,391 which requires the use of two removable shafts located in parallel arms as a part of a clevis.

SUMMARY OF THE INVENTION

This invention has for its object to provide fittings for attachment to fabric, e.g. nylon web-type slings, which overcomes the objections to the prior art devices. It is a further object to provide a fitting and fabric-type sling combination that will accomodate and be adjustable to varying applications at the place of installation and use, is reuseable and develops the full strength of the fabric web strapping and sling.

The invention herein described, is directed to an apparatus to attach and adjust the length of fabric web-type strapping or slings to a metal fitting which has, as a part thereof, spaced parallel sides. Within the sides subsequent to the fitting is a crossbar that is non-rotatably affixed to the parallel sides. The crossbar, in its transverse cross-section configuration defines a curved surface adjoining a flat surface. In following the generation of the curved surface it extends from its top forwardly toward the fitting, toward the bottom and thence rearwardly and upwardly to the flat surface which connects at the top beginning. Preferably, the location of the bottom of the curved surface is such that the working strand of the sling will be in the plane of the tension force of the fitting. A cross-pin is affixed and between the sides rearwardly of and of parallel axis to the crossbar. A removable tension pin is affixed to and between the sides rearwardly of the cross-pin. The sling is defined by a free strand or end and a working strand or end. The free strand extends forwardly around the curved surfaces of the crossbar, thence rearwardly against the flat surface thereof thence around the cross-pin, returning forwardly outside of the working strand and in contact therewith. The cross-pin, in one embodiment may be rotatable and removable, in other embodiments it may be non-removably affixed between the sides, yet rotatable. Another embodiment includes a covering case that is positionable between the sides when the cross-pin and tension pins are removed. The case is opened at its front and has parallel sides connecting with the a top, bottom, and rear portions. A forward slot in each side is nestable against the crossbar. A keyhole opening is provided in each side rearwardly of the forward slot to receive and when moved forwardly lock the cross-pin from removal. A lower slot is located in the rear portion of the case for the exit of the working and whatever portion of the free end of the strap remains. The tension pin is insertable to lock the case from movement. In another embodiment of the invention the crossbar has a curved axial outer surface so as to be smoothly curved from a larger diameter at its center to smaller diameters outwardly and adjacent sides.

DETAILED DESCRIPTION OF THE PREFERRED EMBODIMENT

Before explaining the present invention, in detail, it is to be understood that the invention is not limited in its application to the details of construction and arrangement of parts illustrated in the accompanied drawings, since the invention is capable of other embodiment and being practiced or carried out in a variety of ways. Also, it is to be understood that the phraseology or terminology employed herein is for the purpose for description and not of limitation.

Figure 1:
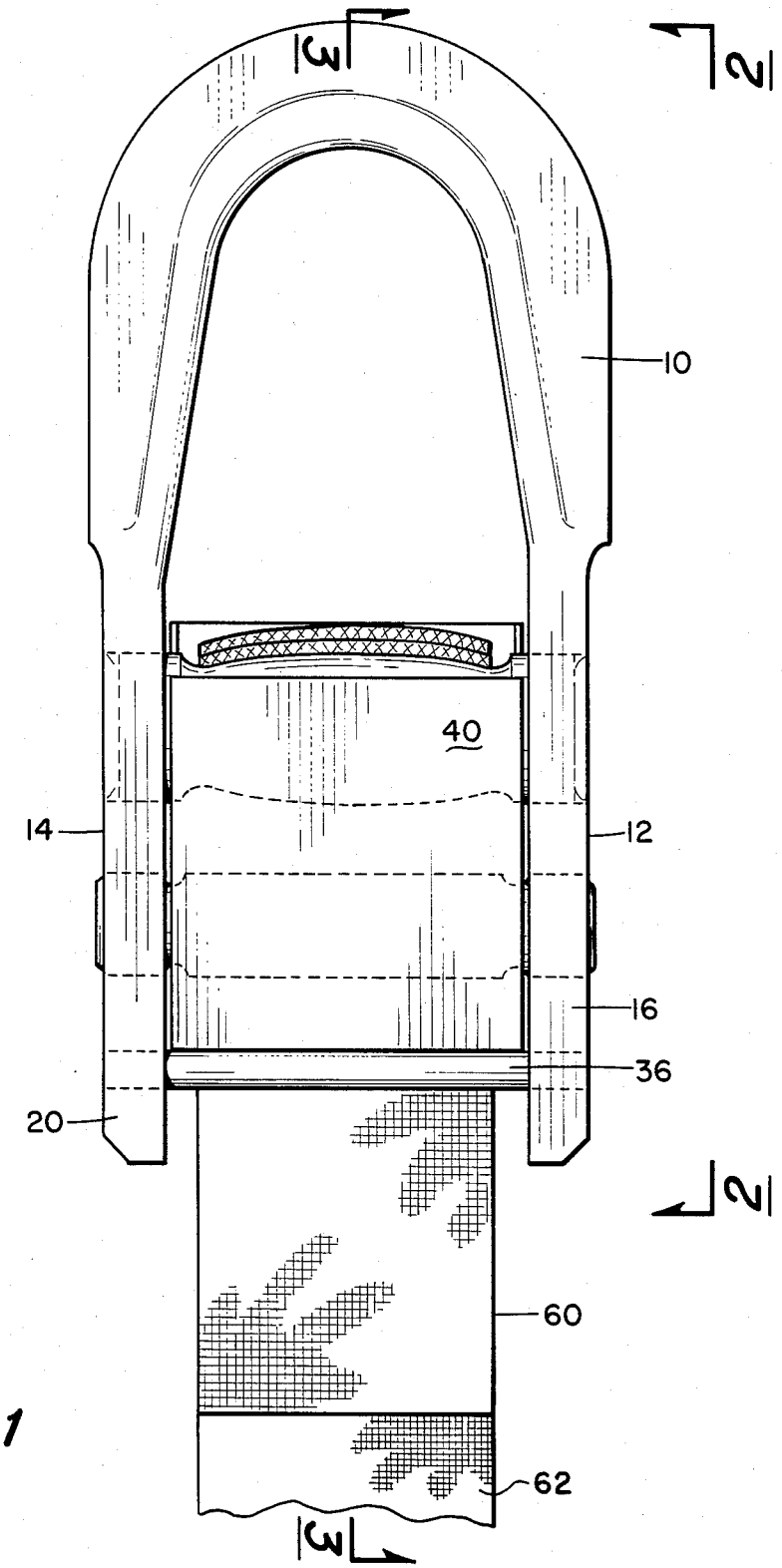
FIG. 1 is a top plan view of one embodiment including a cover or case.
Figure 2:
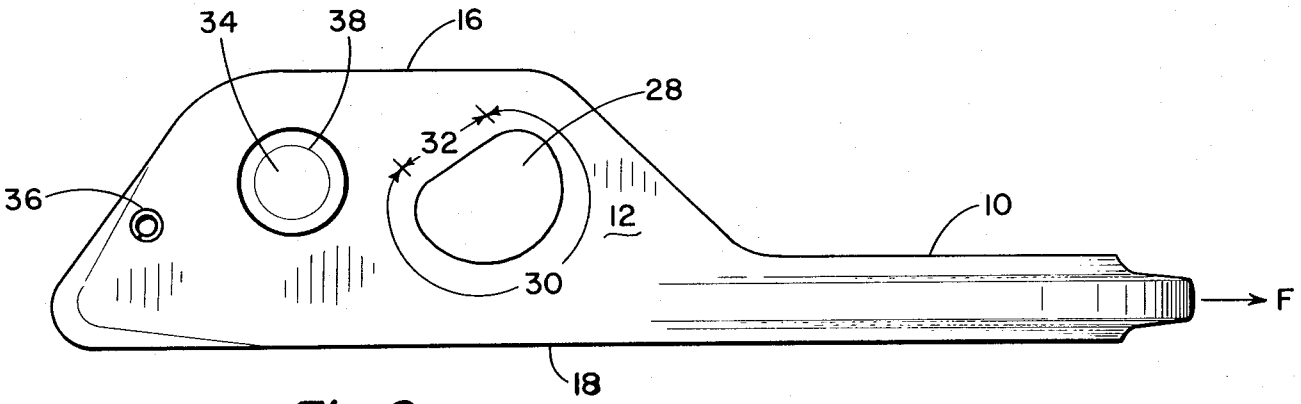
FIG. 2 is a side elevational view taken along line 2—2 of FIG. 1.
Figure 5:
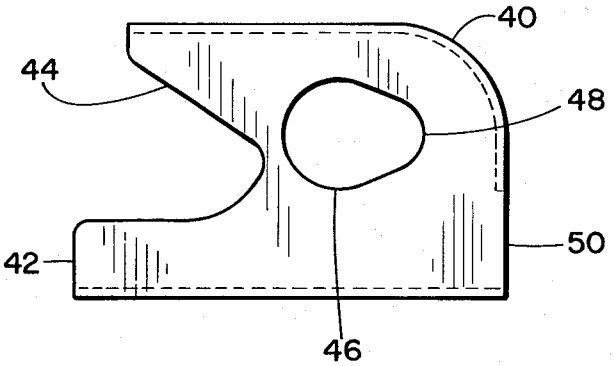
FIG. 5 is a side view of the locking case.

Referring now to FIG. 1 the embodiment of this invention is shown with the fabric-type strapping partially cut away. A fitting generally designated by the numeral 10 has rearwardly thereof spaced parallel sides 12 and 14, and further defining a top side 16 and a bottom side 18 for side 12, and top side 20 and bottom side 22 for side 14 (see FIGS. 2 and 3). A crossbar 28 is non-rotatably affixed to and between the sides immediately rearward of the fitting 10. As shown the crossbar is of a cross-section configuration having a curved surface 30 and a flat surface 32. The curved surface extends from its top forwardly toward the fitting 10 toward the bottom and thence rearwardly to intersect with the flat surface which connects again with the top. Preferrably the location of the bottom of the curved surface is such that the working strand 62, as hereinafter described, will be in the plane of the tension force of the fitting, shown as "F". A cross-pin 34 is affixed to and between the sides 12 and 14 rearwardly of and parallel to the crossbar. A removable tension pin 36 becomes affixed to and between the sides rearwardly of and below the cross-pins. A covering case 40 is best described with reference to FIGS. 3 and 5. The case 40 is positional between sides 12 and 14 when the cross-pin 34 and tension pin 36 are removed. The case is opened at its front end 42 and includes an opening 44 which is nestable with the flat surface 32 and a portion of the circular part 30 of crossbar 28. A keyhole type opening 46 is provided rearwardly of the forward slot to receive the cross-pin 34 when inserted therein. The cross-pin 34 includes smaller diameter portions 38 such that when the case has been positioned between the sides and cross-pin 34 inserted, the case is then moved forwardly such that the keyhole portion 48 will lock into the smaller diameter portions 38 and thus prevent removal of the cross-pin 34. A slot 50 is provided for the exit of the strapping material shown, which has a free end strand 60 and working strand 62. Once the case has been in its locked position, tension pin 36 is then inserted to retain said position.

Figure 4:
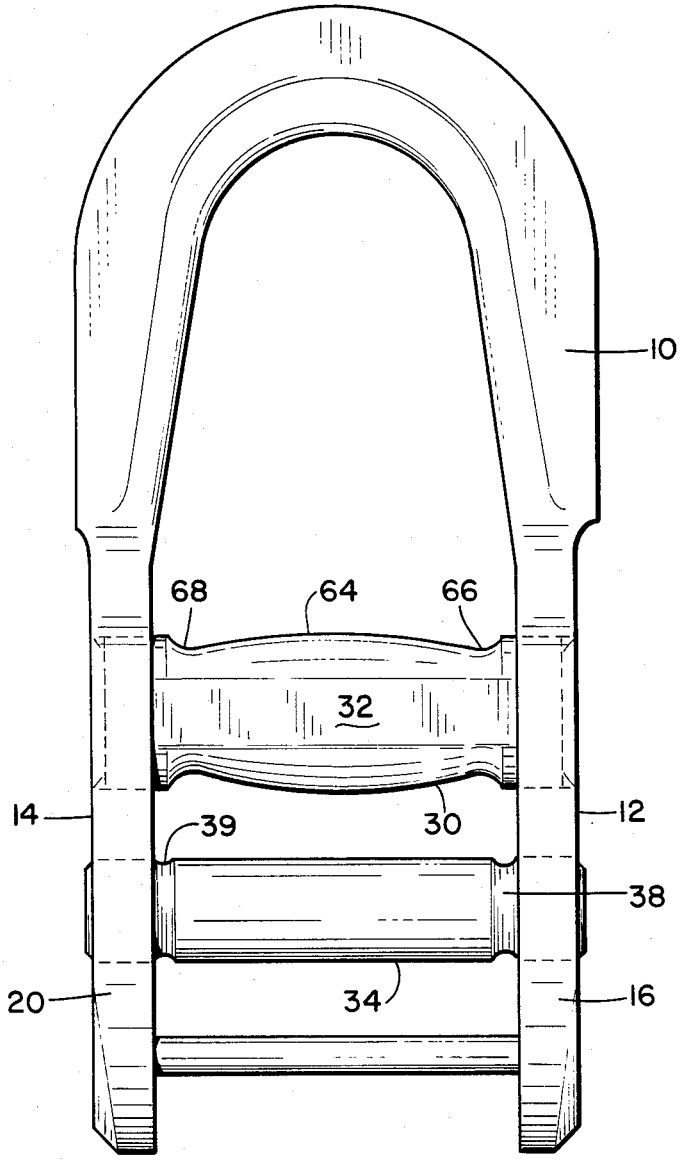
FIG. 4 is a top plan view of the apparatus of FIG. 1 with the case removed.

FIG. 4 is provided as a top plan view of the fitting 10 of FIG. 1 to show the various relationship of parts without the case 40. In one embodiment it is desirable to have the curved surface 30 also curved in a transverse direction by a smooth arch-type curve from a larger diameter central portion 64 to smaller diameter portions 66 and 68 adjacent respective sides 12 and 14 which provides, when the unit is under tension to force a greater load of the webbing in the central portion of the crossbar than in the outer edges to thereby increase sling efficiency.

Figure 7:
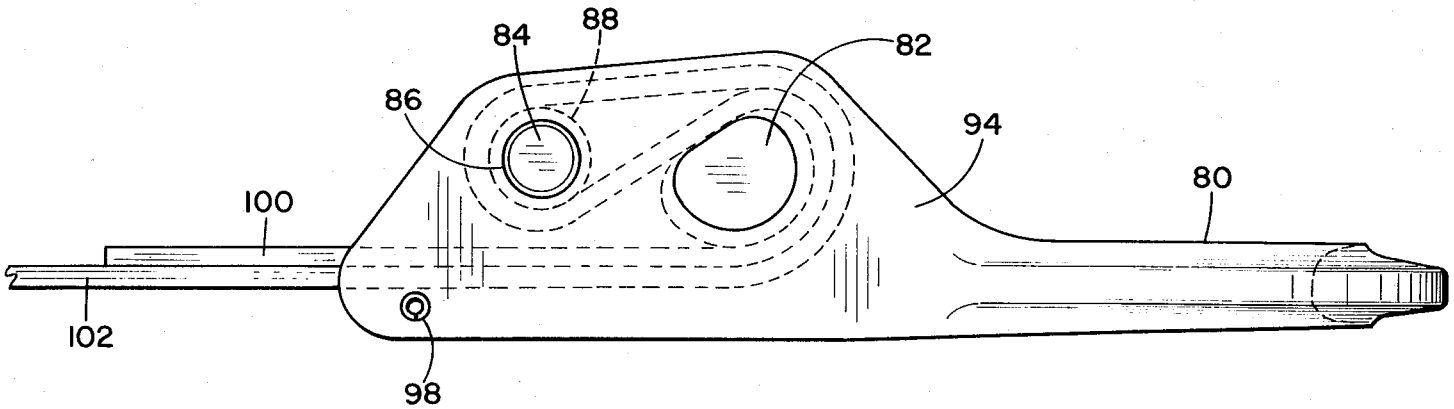
FIG. 7 is a side view of the embodiment of FIG. 6 taken along the line 7—7 of FIG. 6.
Figure 6:
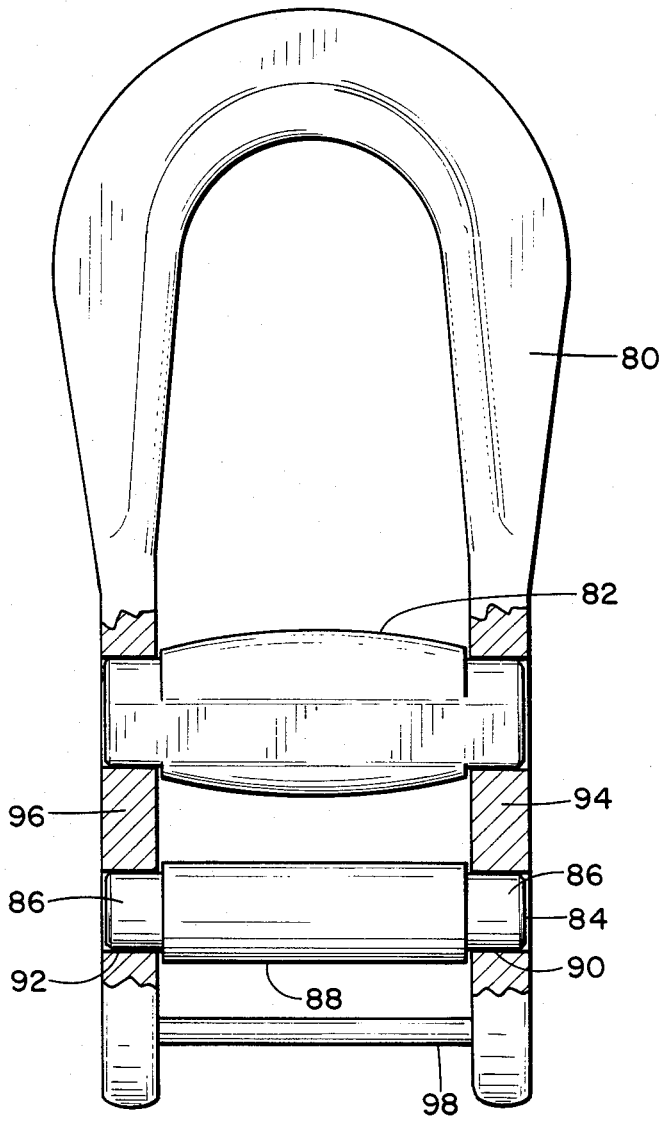
FIG. 6 is a top view of an additional embodiment that requires no case.

The embodiment of FIGS. 6 and 7 is a type which utilizes concepts of this invention without the need for a case. In that regard, fitting 80 includes a crossbar 82 similarly constructed as shown and described, and a cross-pin 84 having end portions 86 and a central rotatable portion 88. In one embodiment the pin 84 comprising elements 86 and 88 may be of one piece construction that is rotatable within the openings 90 and 92 in respective arms 94 and 96. A tension pin 98 similar to that described heretofore is also positioned rearwardly and below the crossbar and cross-pin as shown in FIG. 7. The fabric strapping having a free end 100 and a working strand or end 102 is shown by the dotted lines resting above tension pin 98.

Several methods of securing crossbar 28 or 84 to the parallel sides of the fitting may be used. For instance, the crossbar could be inserted into holes provided in the clevis sides 12 and 14 of FIG. 1 and 94 and 96 of FIG. 6, and then welded or mechanically secured by fasteners. Another method would be to forge pockets in the appropriate sides and during the bending of clevis the crossbar could be inserted into the pockets securing the crossbar to the sides, non-rotatably.

Figure 3:
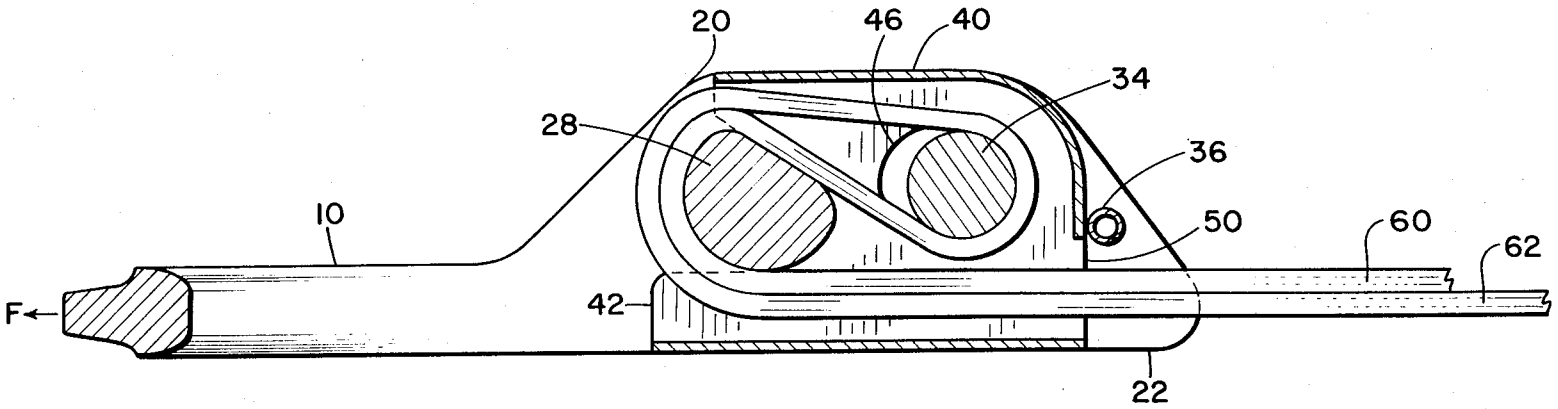
FIG. 3 is a sectional view taken along line 3—3 of FIG. 1.

In the use of the invention the nylon or fabric-type webbing is cut to some pre-determined length and inserted through slot 50 in case 40. A loop is formed in the end of the webbing and carried around crossbar 28 and thence rearwardly. The case 40 is then inserted to a position where its openings 46 are in alignment with the respective holes in sides 12 and 14. Cross-pin 34 is then inserted through one side, the loop formed by the webbing and the other side as shown in FIG. 3. Case 40 is then moved forwardly toward the fitting so that the keyhole will lock within smaller diameter surfaces 38 and 39 of the pin 34. Tension pin 36 is then inserted through appropriate holes in the sides which will secure the case in the locked position. A pull on the working strand of the webbing will remove slack. It is preferred that a short section of the free end 60 be protruding from the rear end of the case 40.

After the sling has been assembled it can be shortened, under slack conditions, by pulling the free strand 60 which will slip the webbing around the crossbar rotating pin 34. Although it is not absolutely necessary that pin 34 be rotatable it does assist in the efforts of adjusting the length of the webbing or strapping material.

Providing there is ample free end of the webbing available, the sling can be lengthened, under slack conditions, by pushing on the working strand of the webbing material toward the fitting and grasping the single layer extending out of the front end of the case and pulling on same toward the fitting which will retract excess webbing that is extending from case 40. After the amount of free end webbing has been efficiently reduced the working end of the strap webbing or strand is pulled to take the slack out of the turn back system.

Case 40 serves several functions in the invention, mainly it provides protection to the turn back elements of the webbing, it retains the working end and free end elements of the webbing in close proximity of each other in their assembled position.

What is claimed is:

1. Apparatus to attach and adjust the length of fabric web type strap to a fitting which has rearwardly thereof two spaced parallel sides defining a top and bottom comprising:

a crossbar non-rotatably and non-movably affixed at a given position to and between said sides immediately rearward of said fitting, said crossbar of cross-section configuration having a curved surface adjoining a flat surface, the generation of said curved surface extending from its top forwardly to said bottom and rearwardly around to said flat surface which connects at its said top, a cross-pin affixed to and between said sides rearwardly of and of parallel axis to said crossbar; and a removable tension pin affixed to and between said sides rearwardly of and below said cross-pin.

2. Apparatus of claim 1 including said strap having a free strand and a working strand, said free strand extending forwardly around said curved surface thence said flat surface of said crossbar, thence around the bottom and rearward portion of said cross-pin thence returning forwardly to said working strand around and in central with said free strand rearwardly, the location of the bottom of said curved surface such that said working strand will be in the plane of the tension force on said fitting.

3. Apparatus of claim 1 wherein said cross-pin is rotatable and removable.

4. Apparatus of claim 3 including a case positionable between said sides when said cross-pin and tension pin are removed, said case open at its front and having parallel sides connecting with top, bottom and rear portions, a forward slot in each side nestable against said crossbar, a key hole opening in each side rearwardly of said forward slot to receive said cross-pin and, when moved forwardly, engage with said cross-pin to prevent removal, and a lower slot in said rear portion for said strap, said tension pin insertable to lock said case from movement.

5. Apparatus of claim 1 wherein said curved surface of said crossbar is axially and smoothly curved from a larger diameter at its center to smaller diameters adjacent said sides.

* * * * *